US008436553B2

(12) United States Patent
Zampini, II et al.

(10) Patent No.: US 8,436,553 B2
(45) Date of Patent: May 7, 2013

(54) TRI-LIGHT

(75) Inventors: Thomas Lawrence Zampini, II, Morris, CT (US); Mark Alphonse Zampini, Morris, CT (US); Thomas L. Zampini, Morris, CT (US); Marie Elena Zampini, legal representative, Loshen, CT (US); David Ross, Orange, CT (US)

(73) Assignee: Integrated Illumination Systems, Inc., Morris, CT (US)

( * ) Notice: Subject to any disclaimer, the term of this patent is extended or adjusted under 35 U.S.C. 154(b) by 0 days.

(21) Appl. No.: 13/198,513

(22) Filed: Aug. 4, 2011

(65) Prior Publication Data

US 2012/0025709 A1 Feb. 2, 2012

Related U.S. Application Data

(63) Continuation of application No. 11/869,663, filed on Oct. 9, 2007, now Pat. No. 8,013,538.

(60) Provisional application No. 60/886,866, filed on Jan. 26, 2007.

(51) Int. Cl.
*H05B 37/02* (2006.01)

(52) U.S. Cl.
USPC ..... 315/291; 315/209 R

(58) Field of Classification Search ..... 315/185 S, 315/224, 225, 246, 247, 291, 297, 307–326
See application file for complete search history.

(56) References Cited

U.S. PATENT DOCUMENTS

| | | | |
|---|---|---|---|
| 4,139,770 | A | 2/1979 | Beyersdorf |
| 4,298,869 | A | 11/1981 | Okuno |
| 4,449,186 | A | 5/1984 | Kelly et al. |
| 5,264,997 | A | 11/1993 | Hutchisson et al. |
| 5,465,199 | A | 11/1995 | Bray et al. |
| 5,561,346 | A | 10/1996 | Byrne |
| 5,659,582 | A | 8/1997 | Kojima et al. |
| 5,783,909 | A | 7/1998 | Hochstein |
| 5,803,579 | A | 9/1998 | Turnbull et al. |
| 5,909,429 | A | 6/1999 | Satyanarayana et al. |
| 5,947,587 | A | 9/1999 | Keuper et al. |

(Continued)

FOREIGN PATENT DOCUMENTS

WO WO 03/017733 A1 2/2003

OTHER PUBLICATIONS

Lee, M., Shunt Battery Charger Provides 1A Continuous Current, EDN Magazine, 1997.

(Continued)

*Primary Examiner* — Jimmy Vu
(74) *Attorney, Agent, or Firm* — Foley & Lardner LLP; Christopher J. McKenna

(57) ABSTRACT

A lighting arrangement includes a light fixture including a plurality of light sources wherein each light source is configured to generate a different color light when energized; and a circuit arrangement included in the light fixture and operatively interposed between the plurality of light sources and a source of electrical power. This circuit arrangement is responsive to brief interruptions in the supply of electrical power of less than a predetermined period to simultaneously de-energize all of the light sources for a full duration of the interruption and to subsequently toggle energization from one light source to the next and thereby produce different color light in response to the cessation of the brief interruption.

22 Claims, 6 Drawing Sheets

U.S. PATENT DOCUMENTS

| | | | |
|---|---|---|---|
| 6,013,988 | A | 1/2000 | Bucks et al. |
| 6,016,038 | A | 1/2000 | Mueller et al. |
| 6,040,663 | A | 3/2000 | Bucks et al. |
| 6,094,014 | A | 7/2000 | Bucks et al. |
| 6,127,783 | A | 10/2000 | Pashley et al. |
| 6,147,458 | A | 11/2000 | Bucks et al. |
| 6,150,774 | A | 11/2000 | Mueller et al. |
| 6,157,093 | A | 12/2000 | Giannopoulos et al. |
| 6,166,496 | A | 12/2000 | Lys et al. |
| 6,194,839 | B1 | 2/2001 | Chang |
| 6,201,353 | B1 | 3/2001 | Chang et al. |
| 6,211,626 | B1 | 4/2001 | Lys et al. |
| 6,234,645 | B1 | 5/2001 | Borner et al. |
| 6,234,648 | B1 | 5/2001 | Borner et al. |
| 6,236,331 | B1 | 5/2001 | Dussureault |
| 6,238,065 | B1 | 5/2001 | Jones |
| 6,249,088 | B1 | 6/2001 | Chang |
| 6,250,774 | B1 | 6/2001 | Begemann et al. |
| 6,253,530 | B1 | 7/2001 | Price et al. |
| 6,288,497 | B1 | 9/2001 | Chang et al. |
| 6,292,901 | B1 | 9/2001 | Lys et al. |
| 6,299,329 | B1 | 10/2001 | Mui et al. |
| 6,304,464 | B1 | 10/2001 | Jacobs et al. |
| 6,305,818 | B1 | 10/2001 | Lebens et al. |
| 6,340,864 | B1 | 1/2002 | Wacyk |
| 6,340,868 | B1 | 1/2002 | Lys et al. |
| 6,384,545 | B1 | 5/2002 | Lau |
| 6,390,983 | B1 | 5/2002 | Mo et al. |
| 6,411,046 | B1 | 6/2002 | Muthu |
| 6,441,558 | B1 | 8/2002 | Muthu et al. |
| 6,443,592 | B1 | 9/2002 | Unger et al. |
| 6,445,139 | B1 | 9/2002 | Marshall et al. |
| 6,459,919 | B1 | 10/2002 | Lys et al. |
| 6,489,731 | B1 | 12/2002 | Bruning et al. |
| 6,495,964 | B1 | 12/2002 | Muthu et al. |
| 6,507,158 | B1 | 1/2003 | Wang |
| 6,507,159 | B2 | 1/2003 | Muthu |
| 6,510,995 | B2 | 1/2003 | Muthu et al. |
| 6,513,949 | B1 | 2/2003 | Marshall et al. |
| 6,528,954 | B1 | 3/2003 | Lys et al. |
| 6,552,495 | B1 | 4/2003 | Chang |
| 6,576,881 | B2 | 6/2003 | Muthu et al. |
| 6,577,080 | B2 | 6/2003 | Lys et al. |
| 6,577,512 | B2 | 6/2003 | Tripathi et al. |
| 6,580,309 | B2 | 6/2003 | Jacobs et al. |
| 6,586,890 | B2 | 7/2003 | Min et al. |
| 6,596,977 | B2 | 7/2003 | Muthu et al. |
| 6,608,453 | B2 | 8/2003 | Morgan et al. |
| 6,609,813 | B1 | 8/2003 | Showers et al. |
| 6,617,795 | B2 | 9/2003 | Bruning |
| 6,621,235 | B2 | 9/2003 | Chang |
| 6,630,801 | B2 | 10/2003 | Schuurmans |
| 6,636,003 | B2 | 10/2003 | Rahm et al. |
| 6,639,368 | B2 | 10/2003 | Sheoghong |
| 6,676,284 | B1 | 1/2004 | Wynne Willson |
| 6,692,136 | B2 | 2/2004 | Marshall et al. |
| 6,720,745 | B2 | 4/2004 | Lys et al. |
| 6,724,159 | B2 | 4/2004 | Gutta et al. |
| 6,734,639 | B2 | 5/2004 | Chang et al. |
| 6,741,351 | B2 | 5/2004 | Marshall et al. |
| 6,762,562 | B2 | 7/2004 | Leong |
| 6,777,891 | B2 | 8/2004 | Lys et al. |
| 6,788,011 | B2 | 9/2004 | Mueller et al. |
| 6,796,680 | B1 | 9/2004 | Showers et al. |
| 6,796,686 | B2 | 9/2004 | Jacob et al. |
| 6,801,003 | B2 | 10/2004 | Schanberger et al. |
| 6,806,659 | B1 | 10/2004 | Mueller et al. |
| 6,831,569 | B2 | 12/2004 | Wang et al. |
| 6,853,150 | B2 | 2/2005 | Clauberg et al. |
| 6,853,151 | B2 | 2/2005 | Leong et al. |
| 6,859,644 | B2 | 2/2005 | Wang |
| 6,922,022 | B2 | 7/2005 | Bucks et al. |
| 6,930,452 | B2 | 8/2005 | De Krijger et al. |
| 6,932,477 | B2 | 8/2005 | Stanton |
| 6,933,685 | B2 | 8/2005 | Gutta et al. |
| 6,933,767 | B2 | 8/2005 | Bucks et al. |
| 6,965,205 | B2 | 11/2005 | Piepgras et al. |
| 6,967,448 | B2 | 11/2005 | Morgan et al. |
| 6,969,954 | B2 | 11/2005 | Lys |
| 6,972,525 | B2 | 12/2005 | Bucks et al. |
| 6,975,079 | B2 | 12/2005 | Lys et al. |
| 6,992,803 | B2 | 1/2006 | Chang |
| 6,998,594 | B2 | 2/2006 | Gaines et al. |
| 7,014,336 | B1 | 3/2006 | Ducharme et al. |
| 7,030,572 | B2 | 4/2006 | Nijhof et al. |
| 7,031,920 | B2 | 4/2006 | Dowling et al. |
| 7,038,398 | B1 | 5/2006 | Lys et al. |
| 7,038,399 | B2 | 5/2006 | Lys et al. |
| 7,064,498 | B2 | 6/2006 | Dowling et al. |
| 7,067,992 | B2 | 6/2006 | Leong et al. |
| 7,071,762 | B2 | 7/2006 | Xu et al. |
| 7,113,541 | B1 | 9/2006 | Lys et al. |
| 7,118,248 | B2 | 10/2006 | Wynne Willson |
| 7,132,804 | B2 | 11/2006 | Lys et al. |
| 7,135,824 | B2 | 11/2006 | Lys et al. |
| 7,139,617 | B1 | 11/2006 | Morgan et al. |
| 7,140,752 | B2 | 11/2006 | Ashdown |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,178,941 | B2 | 2/2007 | Roberge et al. |
| 7,180,252 | B2 | 2/2007 | Lys et al. |
| 7,186,003 | B2 | 3/2007 | Dowling et al. |
| 7,202,608 | B2 | 4/2007 | Robinson et al. |
| 7,202,613 | B2 | 4/2007 | Morgan et al. |
| 7,202,641 | B2 | 4/2007 | Claessens et al. |
| 7,204,622 | B2 | 4/2007 | Dowling et al. |
| 7,221,104 | B2 | 5/2007 | Lys et al. |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,242,152 | B2 | 7/2007 | Dowling et al. |
| 7,253,566 | B2 | 8/2007 | Lys et al. |
| 7,255,457 | B2 | 8/2007 | Ducharme et al. |
| 7,255,458 | B2 | 8/2007 | Ashdown |
| 7,256,554 | B2 | 8/2007 | Lys |
| 7,262,559 | B2 | 8/2007 | Tripathi et al. |
| 7,267,461 | B2 | 9/2007 | Kan et al. |
| 7,274,160 | B2 | 9/2007 | Mueller et al. |
| 7,300,192 | B2 | 11/2007 | Mueller et al. |
| 7,308,296 | B2 | 12/2007 | Lys et al. |
| 7,309,965 | B2 | 12/2007 | Dowling et al. |
| 7,314,289 | B2 | 1/2008 | Montagne |
| 7,319,298 | B2 | 1/2008 | Jungwirth et al. |
| 7,323,676 | B2 | 1/2008 | Duijve |
| 7,329,998 | B2 | 2/2008 | Jungwirth |
| 7,349,454 | B2 | 3/2008 | Quek et al. |
| 7,350,936 | B2 | 4/2008 | Ducharme et al. |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,354,172 | B2 | 4/2008 | Chemel et al. |
| 7,358,679 | B2 | 4/2008 | Lys et al. |
| 7,358,681 | B2 | 4/2008 | Robinson et al. |
| 7,358,706 | B2 | 4/2008 | Lys |
| 7,358,929 | B2 | 4/2008 | Mueller et al. |
| 7,358,961 | B2 | 4/2008 | Zwanenburg |
| 7,387,405 | B2 | 6/2008 | Ducharme et al. |
| 7,388,665 | B2 | 6/2008 | Ashdown |
| 7,394,210 | B2 | 7/2008 | Ashdown |
| 7,420,335 | B2 | 9/2008 | Robinson et al. |
| 7,423,387 | B2 | 9/2008 | Robinson et al. |
| 7,432,668 | B2 | 10/2008 | Zwanenburg et al. |
| 7,443,209 | B2 | 10/2008 | Chang |
| 7,449,847 | B2 | 11/2008 | Schanberger et al. |
| 7,453,217 | B2 | 11/2008 | Lys et al. |
| 7,459,864 | B2 | 12/2008 | Lys |
| 7,462,997 | B2 | 12/2008 | Mueller et al. |
| 7,463,070 | B2 | 12/2008 | Wessels |
| 7,482,565 | B2 | 1/2009 | Morgan et al. |
| 7,482,760 | B2 | 1/2009 | Jungwirth et al. |
| 7,490,953 | B2 | 2/2009 | Holten et al. |
| 7,490,957 | B2 | 2/2009 | Leong et al. |
| 7,495,671 | B2 | 2/2009 | Chemel et al. |
| 7,502,034 | B2 | 3/2009 | Chemel et al. |
| 7,505,395 | B2 | 3/2009 | Ashdown et al. |

7,507,001 B2 3/2009 Kit
7,511,436 B2 3/2009 Xu
7,511,437 B2 3/2009 Lys et al.
7,515,128 B2 4/2009 Dowling
7,520,634 B2 4/2009 Ducharme et al.
7,521,872 B2 4/2009 Bruning
7,525,254 B2 4/2009 Lys et al.
7,538,499 B2 5/2009 Ashdown
7,542,257 B2 6/2009 McCormick et al.
7,550,931 B2 6/2009 Lys et al.
7,550,935 B2 6/2009 Lys et al.
7,557,521 B2 7/2009 Lys
7,569,807 B2 8/2009 Matheson
7,572,028 B2 8/2009 Mueller et al.
7,573,209 B2 8/2009 Ashdown et al.
7,573,210 B2 8/2009 Ashdown et al.
7,573,729 B2 8/2009 Elferich et al.
7,598,681 B2 10/2009 Lys et al.
7,598,684 B2 10/2009 Lys et al.
7,598,686 B2 10/2009 Lys et al.
7,619,370 B2 11/2009 Chemel et al.
7,652,236 B2 1/2010 Cortenraad et al.
7,654,703 B2 2/2010 Kan et al.
7,656,366 B2 2/2010 Ashdown
7,658,506 B2 2/2010 Dowling
7,659,673 B2 2/2010 Lys
7,659,674 B2 2/2010 Mueller et al.
7,665,883 B2 2/2010 Matheson
7,667,409 B2 2/2010 Geerts et al.
7,675,238 B2 3/2010 Cortenraad et al.
7,687,753 B2 3/2010 Ashdown
7,688,002 B2 3/2010 Ashdown et al.
7,689,130 B2 3/2010 Ashdown
7,703,951 B2 4/2010 Piepgras et al.
7,710,369 B2 5/2010 Dowling
7,712,926 B2 5/2010 Matheson
7,714,265 B2 5/2010 Fadell et al.
7,714,521 B2 5/2010 Qian
7,731,387 B2 6/2010 Cortenraad et al.
7,731,389 B2 6/2010 Draganov et al.
7,731,390 B2 6/2010 Van Gorkom et al.
7,737,643 B2 6/2010 Lys
7,738,002 B2 6/2010 Ashdown et al.
7,740,375 B2 6/2010 Zou et al.
7,766,489 B2 8/2010 Duine et al.
7,766,518 B2 8/2010 Piepgras et al.
7,772,787 B2 8/2010 Ashdown et al.
7,777,427 B2 8/2010 Stalker, III
7,781,979 B2 8/2010 Lys
7,802,902 B2 9/2010 Moss et al.
7,806,558 B2 10/2010 Williamson
7,808,191 B2 10/2010 Wu
7,809,448 B2 10/2010 Lys et al.
7,810,974 B2 10/2010 Van Rijswick et al.
7,845,823 B2 12/2010 Mueller et al.
7,850,347 B2 12/2010 Speier et al.
7,854,539 B2 12/2010 Van Duijneveldt
7,868,562 B2 1/2011 Salsbury et al.
7,878,683 B2 2/2011 Logan et al.
7,878,688 B2 2/2011 Paulussen et al.
8,022,632 B2 9/2011 Schulz et al.
8,026,673 B2 9/2011 Lys
2002/0047624 A1* 4/2002 Stam et al. ..... 315/291
2002/0074559 A1 6/2002 Dowling et al.
2002/0145392 A1* 10/2002 Hair et al. ..... 315/185 R
2003/0132721 A1 7/2003 Jacobs et al.
2003/0133292 A1 7/2003 Mueller et al.
2004/0052076 A1 3/2004 Mueller et al.
2004/0090191 A1 5/2004 Mueller et al.
2004/0178751 A1 9/2004 Mueller et al.
2005/0236998 A1 10/2005 Mueller et al.
2005/0275626 A1 12/2005 Mueller et al.
2006/0002110 A1 1/2006 Dowling et al.
2006/0076908 A1 4/2006 Morgan et al.
2006/0114201 A1 6/2006 Chang
2006/0152172 A9 7/2006 Mueller et al.
2006/0221606 A1 10/2006 Dowling
2006/0262521 A1 11/2006 Piepgras et al.
2006/0274526 A1 12/2006 Weston et al.
2006/0290624 A1 12/2006 Ashdown
2007/0029946 A1 2/2007 Yu et al.
2007/0057639 A1 3/2007 Sun et al.
2007/0063658 A1 3/2007 Van Der Veeken
2007/0086912 A1 4/2007 Dowling et al.
2007/0115658 A1 5/2007 Mueller et al.
2007/0145915 A1 6/2007 Roberge et al.
2007/0153514 A1 7/2007 Dowling et al.
2007/0230159 A1 10/2007 Cortenraad et al.
2007/0258240 A1 11/2007 Ducharme et al.
2007/0273290 A1 11/2007 Ashdown et al.
2008/0042599 A1 2/2008 Ashdown
2008/0043464 A1 2/2008 Ashdown
2008/0048582 A1 2/2008 Robinson
2008/0062413 A1 3/2008 Ashdown et al.
2008/0089060 A1 4/2008 Kondo et al.
2008/0094005 A1 4/2008 Rabiner et al.
2008/0122386 A1 5/2008 De Brouwer et al.
2008/0136331 A1 6/2008 Schmeikal
2008/0136796 A1 6/2008 Dowling
2008/0140231 A1 6/2008 Blackwell et al.
2008/0164826 A1 7/2008 Lys
2008/0164854 A1 7/2008 Lys
2008/0167734 A1 7/2008 Robinson et al.
2008/0183081 A1 7/2008 Lys et al.
2008/0239675 A1 10/2008 Speier
2008/0265797 A1 10/2008 Van Doorn
2008/0278092 A1 11/2008 Lys et al.
2008/0278941 A1 11/2008 Logan et al.
2008/0290251 A1 11/2008 Deurenberg et al.
2008/0297066 A1 12/2008 Meijer et al.
2008/0298330 A1 12/2008 Leitch
2008/0315798 A1 12/2008 Diederiks et al.
2009/0002981 A1 1/2009 Knibbe
2009/0021175 A1 1/2009 Wendt et al.
2009/0021182 A1 1/2009 Sauerlaender
2009/0072761 A1 3/2009 Wessels
2009/0079358 A1 3/2009 Shteynberg et al.
2009/0128059 A1 5/2009 Joosen et al.
2009/0134817 A1 5/2009 Jurngwirth et al.
2009/0168415 A1 7/2009 Deurenberg et al.
2009/0179587 A1 7/2009 Van Der Veen et al.
2009/0179596 A1 7/2009 Willaert et al.
2009/0184662 A1 7/2009 Given et al.
2009/0189448 A1 7/2009 Verschueren
2009/0224695 A1 9/2009 Van Erp et al.
2009/0230884 A1 9/2009 Van Doorn
2009/0243507 A1 10/2009 Lucero-Vera et al.
2009/0278473 A1 11/2009 Van Erp
2009/0284174 A1 11/2009 Sauerlander et al.
2009/0321666 A1 12/2009 Hilgers
2010/0007600 A1 1/2010 Deurenberg et al.
2010/0026191 A1 2/2010 Radermacher et al.
2010/0045478 A1 2/2010 Schulz et al.
2010/0072901 A1 3/2010 De Rijck et al.
2010/0072902 A1 3/2010 Wendt et al.
2010/0079085 A1 4/2010 Wendt et al.
2010/0079091 A1 4/2010 Deixler et al.
2010/0084995 A1 4/2010 Baaijens et al.
2010/0091488 A1 4/2010 Ijzerman et al.
2010/0094439 A1 4/2010 Van De Meulenhof et al.
2010/0102732 A1 4/2010 Peeters et al.
2010/0117543 A1 5/2010 Van Der Veen et al.
2010/0117656 A1 5/2010 Snelten
2010/0118531 A1 5/2010 Montagne
2010/0127633 A1 5/2010 Geerts et al.
2010/0134041 A1 6/2010 Radermacher et al.
2010/0134042 A1 6/2010 Willaert
2010/0148689 A1 6/2010 Morgan et al.
2010/0164399 A1 7/2010 Radermacher et al.
2010/0165618 A1 7/2010 Vissenberg et al.
2010/0171771 A1 7/2010 Otte et al.
2010/0181936 A1 7/2010 Radermacher et al.
2010/0188007 A1 7/2010 Deppe et al.
2010/0194293 A1 8/2010 Deurenberg et al.
2010/0207879 A1 8/2010 Fadell et al.
2010/0231133 A1 9/2010 Lys
2010/0231363 A1 9/2010 Knibbe
2010/0244707 A1 9/2010 Gaines et al.

| | | | |
|---|---|---|---|
| 2010/0244734 | A1 | 9/2010 | Van Herpen et al. |
| 2010/0259182 | A1 | 10/2010 | Man et al. |
| 2010/0264834 | A1 | 10/2010 | Gaines et al. |
| 2010/0271843 | A1 | 10/2010 | Holten et al. |
| 2010/0289532 | A1 | 11/2010 | Wendt et al. |
| 2010/0301780 | A1 | 12/2010 | Vinkenvleugel |
| 2010/0308745 | A1 | 12/2010 | Delnoij |
| 2011/0025205 | A1 | 2/2011 | Van Rijswick et al. |
| 2011/0025230 | A1 | 2/2011 | Schulz et al. |
| 2011/0035404 | A1 | 2/2011 | Morgan et al. |
| 2011/0042554 | A1 | 2/2011 | Hilgers et al. |
| 2011/0090684 | A1 | 4/2011 | Logan et al. |
| 2011/0095694 | A1 | 4/2011 | Justel et al. |
| 2011/0285292 | A1 | 11/2011 | Mollnow et al. |
| 2011/0291812 | A1 | 12/2011 | Verbrugh |
| 2012/0019670 | A1 | 1/2012 | Chang et al. |

OTHER PUBLICATIONS

Locher, R, Introduction to Power MOSFETs and Their Applications, Fairchild Semiconductor, 1998.
Perrin, R, Inexpensive Relays Form Digital Potentiometer, EDN Design Ideas, 1998.
Petersen, A., Harness Solar Power with Smart Power-Conversion Techniques, Maxim Integrated Products, Feb. 1999.
Understanding Boost Power Stages in Switchmode Power Supplies, Application Report, Texas Instruments, 1999.
Understanding Buck Power Stages in Switchmode Power Supplies, Application Report, Texas Instruments, 1999.
Shanmugam, S., Design of a Linear Fresnel Lens System for Solar Photovoltaic Electrical Power Source, Center for Robotics Research, 2001.
Zetex, High-Side Current Monitor, Issue 3, Apr. 2001.
Fosler, R, Digitally Addressable Dali Dimming Ballast, Microchip Technology Inc., 2002.
Fosler, R, The RS-232/Dali Bridge Interface, Microchip Technology Inc., 2002.
UPB, Universal Powerline Bus Communication Technology Overview, 2002.
By Staff, Dali Delivers Control and Cost Savings, Headaches Too, Counsulting-Specifying Engineer, Jun. 2002.
Wojslaw, C., DPP adds versatility to VFC, Design Ideas, Nov. 14, 2002.
Curtis, K., High Power IR LED Driver Using the PIC16C781/782, Microchip Technology, Inc., 2002.
Dietz et al., Very Low-Cost Sensing and Communication Using Bidirectional LEDs, Mitsubishi Electric Research Laboratories, 2003.
Miller, R, Digital addressable lighting interface protocol fosters systems interoperablility for lower costs and greater design flexibility, RNM Engineering, Inc., Apr. 2003.
Dunn, J., Matching MOSFET Drivers to MOSFETs , Microchip Technology Inc., 2004.
Fosler, R., Use a Microcontroller to Design a Boost Converter, EON Magazine, Mar. 2004.
Distler, T., LED Effects Stream™ v2.0 Protocol, Revision C, Jun. 2005.
Bowling, S., Buck-Boost LED Driver Using the PIC16F785 MCU, Microchip Technology Inc., 2006.
Di Jasio, L., A Technique to Increase the Frequency Resolution of PICmicro® MCU PWM Modules, Microchip Technology Inc., 2006.
Davmark Ltd., Dali-Protocol, 2007.
Walma, K., Dali: Forerunner of Today's Breakthrough Lighting Technology, Feb. 2007.
Atmel, ATAVRFBKIT/EVLB001 Dimmable Fluorescent Ballast User Guide, Oct. 2007.
Davidovic, et al., Lead-Acid Battery Charger Becomes a Subfunction in a Microcontroller, The Authority on Emerging Technologies for Design Solutions, Mar. 2007.
Klepin, K., Temperature Compensation for High Brightness LEOs using EZ-Color™ and PSoC Express, Cypress Perform, Aug. 2007.
Kremin et al., Multichannel LED Dimmer with CapSense Control-AN13943, Cypress Perform, Jul. 2007.
Kropf, B., Firmware-RGB Color Mixing Firmware for EZ-Color TM-AN16035, Cypress Perform, Jun. 2007.
O'Loughlin, M., 350-W, Two-Phase Interleaved PFC Pre-regulator Design Review, Texas Instruments, Application Report, Mar. 2007.
O'Loughlin, M., PFC Pre-Regulator Frequency Dithering Circuit, Texas Instruments, 2007.
Richardson, C., LM3404 Driving a Seoul Semi Zpower P4 1A LED-RD-134, National Semiconductor, Apr. 2007.
UPB, UPB Technology Description, Version 1.4, 2007.
Zarr, R., Driving High-Power LEOs, Machine Design, Oct. 2007.
Zensys® ASCII Interface, VIZIA, 2007.
Z-Wave Protocol Overview, Software Design Specification, 2007.
CybroTech, Managing Lights with Dali, TN-012, rev 2, Cybrotech Ltd., 2007.
Prendergast, P., How to Design a Three-Channel LED Driver, Cypress Perform, Jan. 2008.
Richardson, C., Matching Driver to LED, National Semiconductor, Jan. 2008.
Takahashi, A., Methods and Features of LED Drivers, National Semiconductor, Mar. 2008.
Renesas, R8C/25 Demonstration Example for DALI Lighting Protocol Stack, REU05BOO77-0100/Rev. 1.00, Jul. 2008.
Soundlight, Operating Manual, DALI and DMX Dekoder 7064A-H Mk1, Jul. 2008.
Conductivity with the BS2/0WL2, EME Systems, Oct. 2008.
Cypress Perform, Implementing an Integrated DMX512 Receiver, Item 10: 39762, Dec. 2009.
Cypress Semiconductor Corporation, PowerPSoC® Intelligent LED Driver, Document No. 001-46319, Rev. *G, 2009.
Ghulyani, L., Simple MPPT-Based Lead Acid Charger Using bq2031, Texas Instruments, 2009.
Dali-AG website, Dali at work.
Seattle Robotics Society, Ross, Kevin, Implementing Infrared Obiect Detection.
Van Dorsten, A., A Low Cost Step-up Converter by IC 555, Circuit Electronic.
EON High Side Current Sensing for String of White LEOs.
International Rectifier, Application Note AN-944, Use Gate Charge to Design the Gate Drive Circuit for Power MOSFETs and IGBTs.
Google—dali query group.
Control Freak Addict, Data Sheet.
Wikipedia, Digital Addressable Lighting Interface (Dali).
Vizia, Z-Wave.
Final Office Action for U.S. Appl. No. 12/209,551 dated Jan. 12, 2011.
Non-Final Office Action for U.S. Appl. No. 12/209,551 dated Aug. 5, 2010.
Notice of Allowance for U.S. Appl. No. 12/209,551 dated Dec. 27, 2011.
Notice of Allowance for U.S. Appl. No. 12/363,349 dated Feb. 1, 2012.
Office Action for U.S. Appl. No. 12/363,349 dated Sep. 14, 2011.
Office Action for U.S. Appl. No. 12/565,492 dated Oct. 5, 2011.
"1-Wire Products Deliver a Powerful Combination . . . ", Mixed-Signal Design Guide, Dallas Semiconductor Maxim, 2005, 7 pages.
Barberis, C. "Precision current sink costs less than $20", EDN Design Ideas.
Bellcomb Technologies Incoporated, "Edges, Joiners, Attachments", Web Address: http://www.bellcomb.com/caps/edges.htm, Apr. 22, 2007, pp. 1-3.
Bookmarks Menu—Controllers/Wireless—Deisgn Ideas, dated Dec. 6, 2012, 1 pg.
Canny, D. "Controlling slew times tames EMI in offline supplies", EDN Design Ideas, Nov. 14, 2002.
Fosler, R. "Use a microcontroller to design a boost converter", EDN design ideas, Mar. 4, 2004, pp. 74-75.
Hardwick, M. "DC power wire also carries clock or data", EDN Design Ideas.
Hexcel Composites, "Sandwich Panel Fabrication Technology", Web Address: http://www.hexcel.com/NR/rdonlyres/B4574C2C-0644-43AC-96E2-CC15967A4b)5/4547 Sandwich Fabrication.pdf, Jan. 1997, pp. 1-16.

Jackson, S. "Circuit protects bus from 5V swings", EDN Design Ideas, Nov. 14, 2002.
Lager, A. "Use a 555 timer as a switch-mode power supply", EDN Design Ideas, Nov. 14, 2002.
Nell, S. "VCO uses programmable logic", EDN Design Ideas, Nov. 14, 2002.
Richardson. C., LM3404 Driving a Seoul Semi Zpower P4 1A LED-RD-I34, National Semiconductor, Apr. 2007, 6 pages.
Shill, M. "Simple logic probe uses bicolor LED", EDN Design Ideas.
Witt, J. "Switched-capacitor regulator provides gain", EDN Design Ideas.
Young, R. "Power circuit terminates DDR DRAMs", EDN Design Ideas, Nov. 14, 2002.

* cited by examiner

1030
U1
LT3474
1 VIN
BOOST 6
SHDN 10 SHDN
SW 5
9 RT
BIAS 7
11 REF
OUT 2
13 VAD
PWM 14
12 VC
LED 3
GND GND
8 15
C2
C311
LL
1 2
D2
BL40
C4
1442
1444
1446
LED1
LED3
LED5
LED2
LED4
LED6
1440
1450
Q1
IRLL2705CT
1100
Q2
IRLL2705CT
1110
Q3
IRLL2705CT
1120
Continued from Sheet Fig. 3A

TRI-LIGHT

CROSS-REFERENCE TO RELATED APPLICATIONS

The present application claims priority to and is a continuation of U.S. Non-provisional application Ser. No. 11/869,663, entitled "TRI-LIGHT" and filed on Oct. 9, 2007 now U.S. Pat. No. 8,013,538, which claims the benefit of and priority to U.S. Provisional Application No. 60/886,866, entitled "TRI-LIGHT" and filed on Jan. 26, 2007, all of which are incorporated herein by reference in their entirety.

FIELD OF INVENTION

The present invention relates generally to LED lighting, and more specifically, to LED lighting in which color generation is toggled between an off state, a first color generation, a second color generation and so on, remotely by interrupting power to a microcontroller circuit arrangement, which controls a plurality of LED light sources that are positioned within a lighting fixture.

BACKGROUND OF THE INVENTION

In marine lighting applications, typically when using conventional lighting, such as that of halogen, incandescent, or fluorescent light sources, in order to achieve two different colors of light at the same location (i.e. a helm area) two different light fixtures are usually needed. In this case, either two fixtures are arranged side by side, one being a fixture having a white light with a color filter, such as a red filter, the other being a single fixture having a white light and possibly including a color filter. The addition of a color filter is, however, disadvantageous as luminaire efficacy is significantly reduced due to the fact that when red light that required (for example), only the red light is permitted to pass through the filter, the other colors being absorbed and therefore energy wasted.

In the case whereas a single fixture is used and yet two colors of light are desired, a further problem is that the filter must be changed when it is necessary to change from white to red light, thus in the case of having multiple fixtures installed within a single installation, for example six (6) fixtures within a helm area, all six fixtures would require filters to be installed.

There are several advantages of having the capacity to produce two or more colors within the same fixture as compared to having two fixtures, installed side by side. These advantages include a reduction in installation time (i.e. 1 fixture is required to be installed instead of two), wiring requirements, and the number of mounting holes that are required to be bored into the mounting surface. In addition, as more and more of today's lighting applications are becoming more streamlined, a single light fixture achieving the function of what would be traditionally two light fixtures, helps reduce clutter and better streamline the installation. Furthermore, as lighting becomes more and more a style/image and consumers look for options in how for example, their boat is illuminated at dockside, having the option of multiple colors within a fixture allow the user the option to have a practical lighting color for general operation (i.e. white light), but also have the option to change the lighting color on the entire vessel to for example blue, a color considered more aesthetic than functional due to the eye's poor response to the blue wavelength. While in traditional applications two colors of light (two separate lighting fixtures) may have been used in a helm area, through the use of the present invention, any location with a light source can now offer multiple colors. A control system which enables an operator to switch between the different colors, is therefore still wanting.

One arrangement which has been proposed in connection with the above need is disclosed in U.S. Pat. No. 6,967,448 to Morgan et al. This patent discloses the use of a remote user interface to provide control signals for controlling LED lights contained within a light source without having to use color filters. External signals are provided to a controller associated with the light source so the radiation (i.e. the light color) output by the light source is controlled.

In Morgan, individual LEDs or groups of the same color LEDs are coupled to independently controllable output ports of the controller associated with the light source. The controller is configured to modify one or more variable parameters of one or more illumination programs based on interruptions in the power signal. Morgan discloses a variable color radiation output from the LEDs based on the particular illumination program selected.

One drawback associated with the use an arrangement such as disclosed in Morgan et al. when it is used in a general lighting application, is wiring/circuitry/programming complexity and expense. That is to say, multiple controllers are required one per LED channel such that each LED controller may be controlled or dimmed in order to create the intended color mixing effect.

Another drawback associated with the above type of arrangement is that it is not possible to connect a high brightness LED directly to a microcontroller output when LEDs requiring high currents are used as a light source.

Further, in the case of a marine installation, for example, as a battery system is often used to power the lights, input voltages can fluctuate, in some cases as much as +/−3VDC.

In the case of general illumination, an LED based product will require regulation in order to maintain continuous light output and longevity over this full range. Other expenses required in the event that a color mixing system include a microcontroller with multiple PWM outputs. However, most small/inexpensive microcontrollers are not well equipped to trigger color control programs of the nature envisaged in arrangements such as disclosed in the above mentioned Morgan et al. patent.

Internal to the color mixing fixture, the device requires the generation of such signals another expensive device on the system, most likely being microcontroller based in order to send accurate pulses required by the microcontroller in Morgan such that the signal may be accurately interpreted and the proper program executed.

In other configurations, LED fixtures have been created with two or more colors of light within the same fixture however in the case of these fixtures, while the LEDs may include a common ground, each separate color requires an individual positive input, thus in the case of a two color fixture, there would be two positive wires and a common ground, thus in this case, this light could not be used as a direct retrofit for a conventional light unless additional wiring is run to the light location. Furthermore, in this scenario, each light color would require an independent LED driver in which case additional expense is added to each LED color, whereas in the present invention, one LED driver is shared for all light colors.

A low cost, retrofit compatible, LED lighting fixture having the capacity to selectively produce a series of different/multiple color lights is therefore still wanting in the art.

SUMMARY OF THE INVENTION

One aspect of the present invention is directed to providing an arrangement which enable the use of existing wiring and switches normally associated with a signal color light source to be used with a light fixture capable of producing multiple colors.

Another aspect of the invention is to provide the above mentioned light fixture with circuitry that is configured to respond to interruptions in the supply of current thereto caused by the operation of the switch.

Yet another aspect of the invention is directed to providing an arrangement wherein only two wires, positive and negative (or ground) are necessary between the power source of EMF (e.g. battery) in order to control the toggling of the color which can be produced by the light fixture, from one color to the next.

A further aspect of the invention is directed to providing an arrangement that is responsive to a wide tolerance pulse that may be generated simply by quickly opening and closing a conventional switch, or the operation of a relay which normally remains open only for a predetermined short period, this period varying depending on the operator (i.e. a younger person may quickly and forcefully toggle through the light colors whereas an older person may slowly engage the switch, the difference between both users being that as much as a second, thus reiterating the point that a wide tolerance pulse is accepted.

A still further aspect of the invention is directed to providing a light fixture which can be remotely controlled by a user who, by simply pressing a switch, is able to toggle between the generation of different color lights. In at least one embodiment the sources of light can be LED such as a plurality of red LEDs, and a plurality of blue LEDs and a plurality of white LEDs which are positioned in a single lighting fixture.

Thus, rather than having to individually control and mix the colors of various LEDs, in given embodiments of present invention, the user would select, for example, only the red LEDs. With Using the same simple a switch, the user can then cycle next to only the blue LEDs. Under these conditions the red and white light producing LEDs would be turned off while the blue LEDs would remain energized.

Subsequent operations of the switch would toggle to a state wherein the next press of the switch, the red and blue LEDs would be turned off and the white LEDs to be turned on, while the blue LEDs remained off.

Of course it should be noted that the invention is not limited to two or three "pure" colors and that more can be used simply by extending the toggling selection. Indeed, a while the basic embodiments of the invention are directed to selective energization of a series of the same color LED, it is within the scope of the invention to mix the color of the LED in a series so that a pink for example, can be generated via the energization red and blue of that series.

In this manner, the invention enables a low-cost LED lighting fixture having the capacity to produce multiple color lights.

At this point it should be noted that the embodiments of the invention are not limited to red, while and blue color producing LED and that other colors can be generated such as green, amber, etc.

The aesthetics of the embodiments of the present invention are better when compared to a configuration of two halogen lights installed side by side such that the halogen configuration's appearance is unnatural. In addition, the invention obviates the use of colored filters behind the lens of the halogen when not in operation, create a dark, unnatural effect on the light lens.

In a nutshell, the present invention is directed to providing embodiments wherein two or more light sources are housed within a single fixture and along with circuitry which allows the user to toggle between off-first color-second color-nth color-off. This, for example, in marine applications allows a user to change the color of exterior lighting by quickly switching the power on and off. In this manner, the color of boat illumination can be selectively changed from red to white to blue for example. Merely by way of example the red light can used for night operation, the white for normal operation or maintenance, and the blue for dock side aesthetics.

While other methods exist for creating multi-color fixtures, the embodiments of the present invention are such that it requires only the existing wiring which is conventionally used with single color fixtures to implement a multi-color function.

Other applications whereas wherein multi-color fixtures offer an advantage would be in the case of a recessed can light wherein a hybrid LED light fixture may be created such that the LEDs are recessed internal to the can and whereas the traditional light source is to create general illumination whereas the multi-color LED light source provides accent lighting.

In this type of arrangement the, colors are changed by simply toggling interrupting the supply of the power using off then on for a brief period with the an existing off the shelf light switch or breaker used to control traditional light sources. Following each interruption there is a brief delay following which the illumination of the next LED or set of LEDs are energized.

In one embodiment of this invention, the microcontroller used in the present invention is a low cost, 8 pin microcontroller. This microcontroller is configured to selectively ground field effect transistors (FET) to complete completing a circuit, rather than "driving" the FET such that the FET switches on and off to control intensity.

The LED Driver is a switching regulator that powers the LEDs via constant current, therefore no matter what the input, the output remains the same defined current.

A Linear regulator, which also takes a wide range of inputs for powering the microcontroller, while less efficient than a switching regulator, could also be used.

It should be noted that in the case of switching colors, the power to the microcontroller will cycle off as well, and that it is only due to the provision of the capacitor 40 (see FIG. 1) that keeps the microcontroller powered—if the power is interrupted for too long (e.g. 3 seconds), the capacitor 40 discharges and the microcontroller 50 is back to the beginning of the cycle of colors. This also functions as a reset for the lights in the event that multiple light are used and one gets out of sync.

Still other merits and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF PREFERRED EMBODIMENTS

Figure 1:
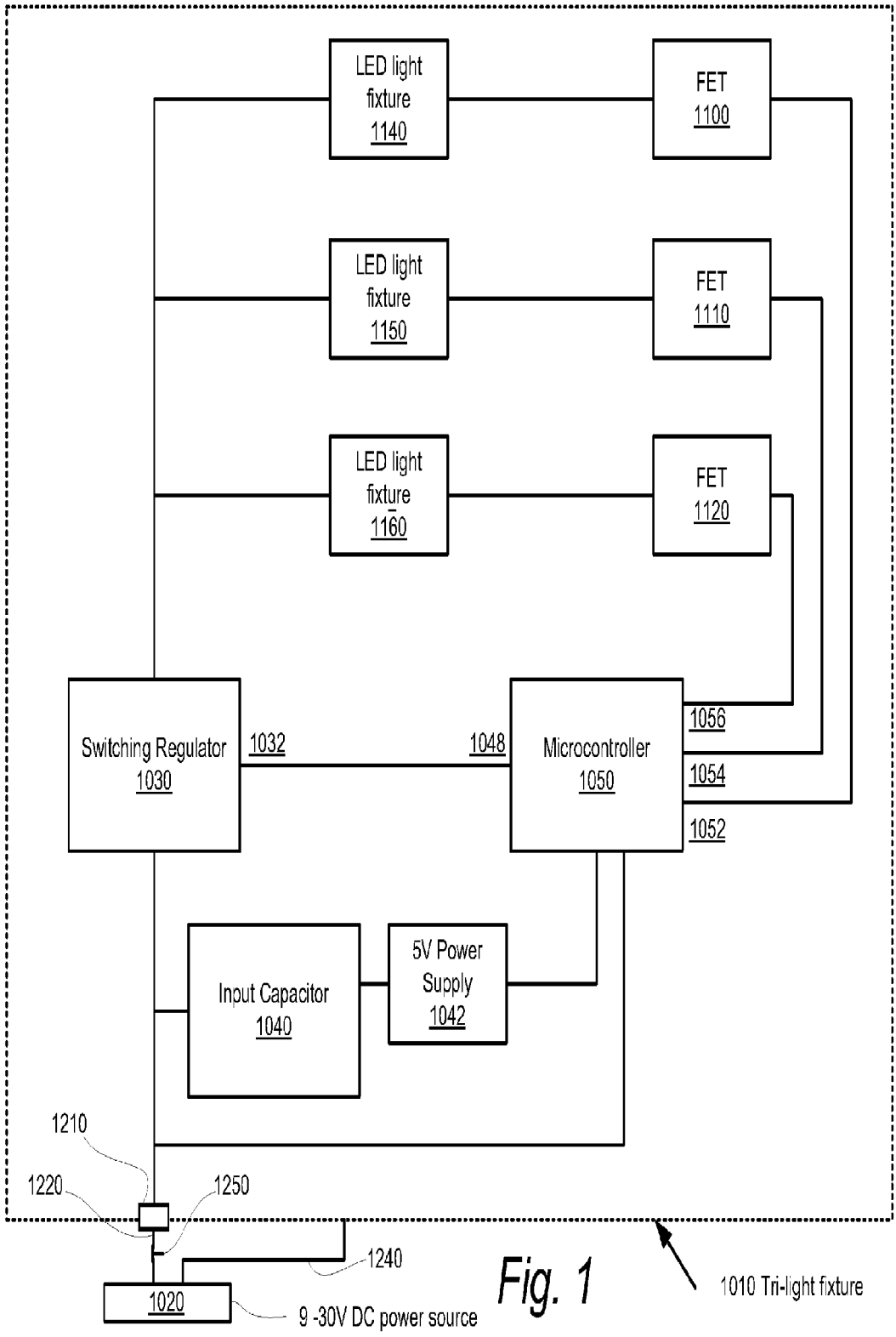
FIG. 1 is a schematic block diagram illustrating the basic arrangement of a tri-light (three color) embodiment of the present invention.
Figure 2:
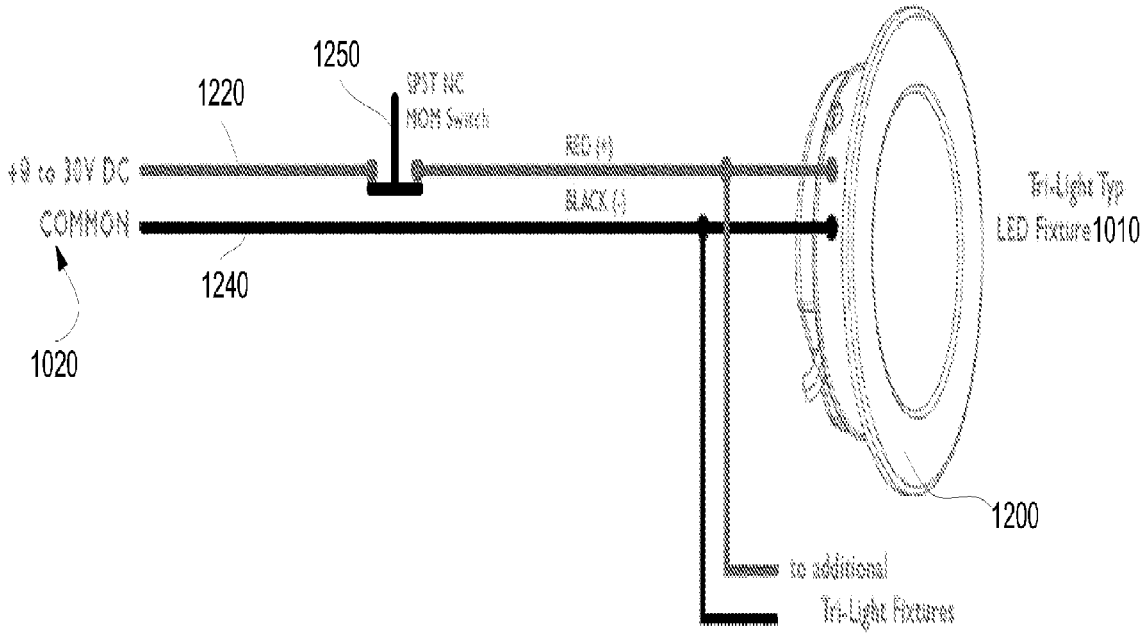
FIG. 2 is a schematic diagram of a tri-light (three color) LED fixture which includes the circuit arrangement depicted in used in FIG. 1.

FIGS. 1 and 2 illustrate, a so called tri-light assembly 1010 which is configured to produce three different colored light. It will be appreciated that irrespective of the fact the disclosed embodiments are referred to as tri-light, in that utilizes three different three different color LEDs to produce three different colored light, the assembly 1010 could, as noted above, also be arranged to produce two (a bi-light) or four (a quad-light) or five (penta-light) or more different colors. Thus, it should be understood that the term tri-light is used for illustrative purposes only not limiting to the scope of the invention.

In this embodiment, the tri-light assembly 1010 includes a housing 1200 (see FIG. 2) and receives power from a power source 1020 (9 to 30VDC) via a switch 1250. In this embodiment the housing 200 has what shall be referred to as a power input 1210. That is to say, a connection site/arrangement which allows the operatively electrical connection of the positive and negative power lines 1220, 1240 that enable current to be supplied to the 1200.

It should be noted that in this particular embodiment the housing 1200 floats (electrically) and is not grounded to anything. However, there will be instances wherein a ground can be established without the provision of wiring specifically for that purpose and that the housing can be grounded through an electrically conductive chassis or the like.

The +9 to 30V DC input wire 1220 and a common wire 1240 connection streamlines the installation to two wires, making it a drop in replacement for most convenient light sources including the embodiments of the invention. In fact, it enables a mixture of single light and multi-color arrangements such as typified by the embodiments of the invention, with no need to change existing wiring/switches. Furthermore, applications whereas multiple colors of light would be traditionally excluded, may now without additional expense of wiring or installation become areas of multiple colors.

As illustrated in FIG. 1, the external power source 1020 is electrically connected (via switch 1250 (also see FIG. 2) and the power input 1210) to a switching regulator 1030, an input capacitor 1040, and a 5V linear regulator 1042. A microcontroller 1050 is powered by the 5V linear regulator 1042, in the illustrated manner, and the input capacitor being in parallel with the linear regulator 1042. The microcontroller 1050 is configured to respond to interruptions in the voltage from the power source 1020 and detect the operation of a switch 1250 which will described in more detail later.

The 5V power supply 1042 connects the input capacitor 1040 with the microcontroller 1050. The interposition of the 5V power supply enables the acceptance of a wide range of input voltages (i.e. 9 to 30VDC) while providing a stable 5V source to power the microcontroller 1050. The capacitor 1040 is selected to maintain the supply of the 5V supply for a period of 3-4 seconds for example, and thus maintain the operation of the microcontroller 1050 for a period sufficient for an interruption to the power supply which lasts about 1 second (for example) to be detected by the microcontroller 1050. In this embodiment, the microcontroller 1050 is alerted to the absence of power being supplied via line 1212.

The microcontroller 1050, in turn is electrically connected to a first field effect transistor (FET) 1100, a second FET 1110 and a third FET 1120. Each of these FET can be CMOS or PMOS.

Each FET 1100, 1110, 1120 controls the connection between a respective LED light source 1140, 1150, 1160, and ground. The LED light sources 1140, 1150, 1160 can be wired in series or in parallel. However, in given circumstances series wiring is preferred ensures equal distribution of current to each of the LEDs.

Merely by way of example, the color of the first plurality of LED constituting the first LED light source 1140 can be selected from at least white, white warm, green, blue or red and other colors. Likewise, the color of the second LED light source 1150 can be selected from at least white, white warm, green, blue or red and other colors. In the same manner, the color of the third LED light source 1160 is selected from at least white, white warm, green, blue or red and other colors. Furthermore, the LED light source 1140, 1150, or 1160 could consist of two different LEDs for example a blue and red LED, thus when a current is applied, a resultant mixed color will be displayed (i.e. pink).

Upon an FET being rendered conductive by a control signal from the microcontroller 1050, current is permitted to flow from the switching regulator 1030 to ground via the LED light fixture associated with the conductive FET. It should be noted that, in this instance, only after the FET is activated is the switching regulator turned on via 32/48—this ensures no surges or hot connections to the LEDs.

The microcontroller 1050 used in this embodiment of the present invention is, merely by way of example, a low cost, eight pin microcontroller.

In this embodiment, the microcontroller 1050 is arranged/programmed to respond to the voltage appearing on line 1212 to toggle from a state wherein voltages appearing on output ports/pins 1052, 1054 and 1056 of the microcontroller 1050 all assume a zero level (no FET is grounded and there is no current flow through any of the LED light sources) to a state wherein voltage at port 1052 is high (FET 100 is rendered conductive, connects the LED light fixture 1142 to ground thus energizing the series of LED which comprise the light source). At this time, the voltage at ports 1054 and 1056 remain low. In response to the next short voltage interrupt, the voltage at port 1052 falls and that on port 1054 assumes a high level. The following interrupt induces the situation wherein the port 1056 is solely raised to a high level. Following this all ports return to their initial low levels in readiness for the next toggling.

As will be appreciated, the switching regulator 1030 is arranged to constantly supply the LED light sources with current and that the microcontroller 1050 simply renders a field effect transistor (FET) conductive to establish a ground connection thus completing a circuit, and therefore differs from the situation wherein the FET are driven in manner such that the FET switches on and off to control intensity.

It should be noted that, as all of the circuitry positioned in the light fixture 1010 is powered by the external power source 1020, all of the circuits with the exception of the microcontroller 1050, lose power and shut down during a power interruption. If the interruption is brief, that is less than the duration for which the capacitor 1040 can sustain the 5V supply to the microcontroller 1050, then all of the LED light sources

1140, 1150 and 1160 are momentarily de-energized. When the interruption terminates and power is supplied again, the FET grounding which is induced by the microcontroller 50 re-induces the appropriate illumination for the currently toggled status. Thus, in the case of a brief interruption of 1-2 seconds duration then even if one of the light sources was energized, then there will be a discrete interruption.

More specifically, during this interruption, several things are happening in this embodiment:

1) the switching regulator has no power available and thus none of the LEDs are illuminated;
2 the input capacitor has enough charge such that the 5V power supply is still live providing power to the microcontroller;
3) the microcontroller notes that the power source is gone for at least defined duration of time (thus does not change colors on a false alarm such as in response to spike in the power supply); and
4) once the power source comes back up, the microcontroller quickly shuts off the switching regulator (note that the micrcontroller has the switching regulator already shut off when the power is gone), via connection 48/32 the microcontroller then changes to the next FET as designated in the toggle control program and then turns back on the switching regulator such that which ever LEDs are connected to ground via their respective FET are illuminated.

On the other hand, if the interruption is prolonged, that is to say, sufficiently long for the capacitor 1040 to discharge and for the microcontroller to shut/power down, then all of the settings in the microcontroller return to default settings (flash memory) where none of the FET 1100, 1110 and 1120 are rendered conductive. Once in this state a further brief interruption in input voltage 1020 would be required to inducing toggling to again to introduce the first color of light.

This return to the default settings, however provides an opportunity to rest all of the plurality of light fixtures which are connected to the common source of power. That is to say, by causing switch 1250 to remain open for more than the duration for which the capacity can maintain the 5V supply to the microcontroller, it is possible to cause all of the microcontrollers which are involved in the system to reset to their default settings and correct any asynchronous operation that my have inadvertently occurred. That is to say, should an error have occurred wherein all of the light fixtures are not producing the same colored light (viz., wherein a miss toggle has occurred in one of the light fixtures), then a very simple reset procedure is available.

In a nutshell, this embodiment of that invention is configured such that internal to the tri-light assembly 1010 it is the switching regulator 1030 that drives the LED light sources 1140, 1150, and 1160, an input capacitor 1040, a 5V power supply 1042 that powers the microcontroller 1050, the microcontroller connected to the switching regulator 30 and three FETs 1100, 1110, and 1120. These FETs are configured to selectively connect the LED light sources to ground, thus completing the circuit. The entire fixture is powered by power source 1020, this power source supplying power to the 5V power supply 1042 as well as the switching regulator 1030.

It should be noted that while the power supply 1042 as illustrated, is a linear regulator just as the switching regulator 1030 is configured as a switching regulator, the topology whether linear or switching, whether buck, boost, sepic, buck-boost, etc. may vary depending on the application.

In operation, the light sources are selectively illuminated with a constant voltage from the voltage source 1020. That is to say, the switching regulator 1030 acts as a source of constant current for all of the LED light sources 1140, 1150, or 1160, and the color illumination dependent on which FET 1100, 1110, or 1120 is rendered conductive by the microcontroller 1050.

It should be noted that in this embodiment in order to change colors, a user via a simple switch or relay, for example a toggle switch or momentary toggle switch, simply interrupts the supply of power from the power source 1020 for 1 second or less.

The basic operation is as follows. A user briefly (one second or less) disrupts power by using switch 1250 to signal the LED light assembly(s) to change color. For example, the supply of power through a selected one of the LED light sources 1140, 1150 and 1160, is changed when the user disrupts power. The light color sequence is configured by software is given embodiments is often, LED1, LED2, LED3, off, LED1, etc.

The microcontroller 1050, prior to changing the LED light output, shuts off the LED driver 1030 via a shutdown pin (see shutdown pin 7 in FIGS. 3A and 3B), and closes the currently close to FET and closes the next and that power on the driver.

Figure 3A:
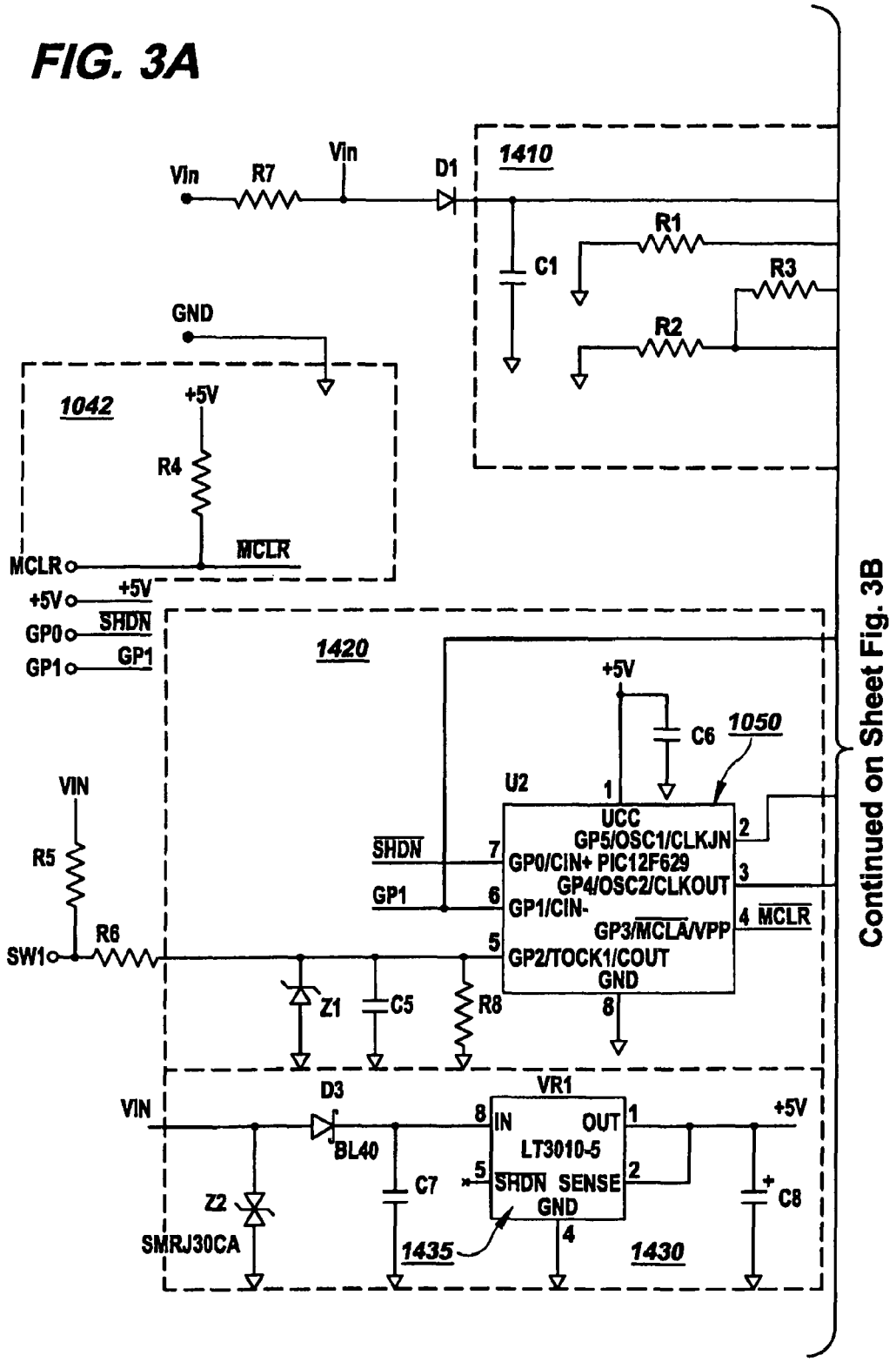
FIGS. 3A and 3B are circuit diagrams diagram illustrating a specific example of circuitry schematically depicted in FIG. 1.
Figure 3B:
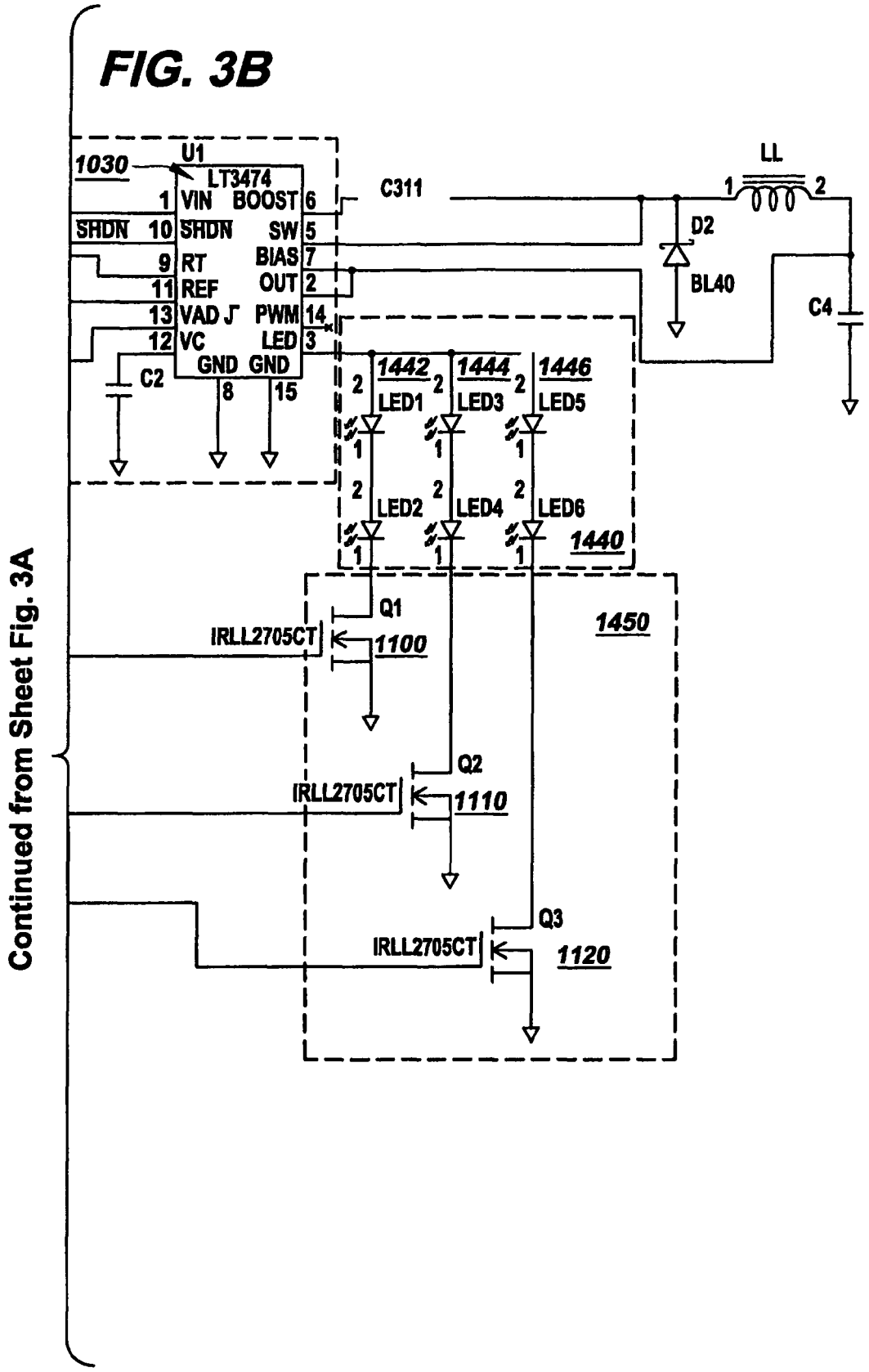

Referring now to FIGS. 3A and 3B, a specific wiring diagram for the Tri-Light assembly 1010 of FIG. 1 is illustrated. This arrangement includes a switching regulator circuit 1410 (add L1, D2, and the other components to the right of the dotted region) having the switching regulator 1030, a grouping of LEDs 1440 comprising the first LED light source 1140, a second plurality of LEDs comprising the second LED light source 1150 and a third plurality of LED which comprising the third LED light source 1160.

An FET arrangement 1450 includes the FETs 1100, the second FET 1110 and the third FET 1120, circuited as shown.

A microcontroller circuit 1420, a voltage regulator circuit 1430 including a voltage regulator 1435 and a 5V power supply is circuited in the manner depicted. The switching regulator circuit 1410 includes a switching regulator 1030, a plurality of transistors and a plurality of capacitors and an inductor arranged in the illustrated manner. The switching regulator which in this embodiment comprises part number LT3474, is available from the Linear Technology Corporation, Milpitas Calif. The teachings of the LT3474 datasheet are incorporated herein by reference.

The switching regulator 1030 is a fixed frequency step-down DC/DC converter and operates as a constant-current source. According to another embodiment of the invention, switching regulator 1030 provides a plurality of PWM circuitry. The PWM circuitry utilizes current mode PWM architecture and provides fast transient response and cycle-by-cycle current limiting. In the embodiment illustrated in FIGS. 3A and 3B, pin 4 VIN of switching regulator 1030 supplies current to the switching regulator 1030 internal circuit and to the internal power switch. The pin 10 SHDN of switching regulator 1030 is used to shut down the switching regulator and the internal bias circuits. The pin 10 SHDN of switching regulator 1030 is electrically coupled to microcontroller 1050 Pin 7. The switching regulator 1030 is powered through pin 4 which is electrically coupled to Vin. The switching regulator 1030 provides a high low signal to SHDN pin 10 which turns the driver on and off to changing colors of LED light sources 1140, 1150 and 1160.

As depicted in FIGS. 3A and 3B, the LED 1440 is such that the first LED light source 1140 includes at least a LED1 and a LED2. Note that it is within the purview of the embodiments of the invention to use a single LED if so desired.

In one embodiment of the present invention, the color of LED1 and LED2 may be one of white, white warm, green, blue or red and other colors as noted above. The input of LED1 is electrically connected to the LED pin 3 of switching regulator 1030.

According to the circuit arrangement illustrated in FIGS. 3A and 3B, the output of LED1 is electrically coupled to the input of LED2. The output of LED2 is electrically connected to the first FET 100. The second LED light source 1150 includes at least LED3 and LED4. The input of LED3 is electrically coupled to the LED pin of switching regulator 1030. The output of LED3 is electrically connected to the input of LED4. The output of LED4 is electrically connected to the second of FET 1110. The third LED light source 1160 comprises LED5 and LED6. The input of LED5 is electrically connected to the LED pin of switching regulator 1030. The output of LED5 is electrically adapted to the input of LED6. The output of LED6 is electrically connected to a third FET 1120.

The microcontroller circuit 1420 includes the microcontroller 1050, a plurality of transistors and a plurality of capacitors organized and connected in the illustrated manner. The microcontroller 1050 is, in this instance an 8-Pin, flashed based 8 bit CMOS microcontroller. This microcontroller which can comprise part number PIC12F629, available from the Microchip Technology Inc., Chandler Ariz., although almost any properly programmed microcontroller or microcontroller can perform the software functions described herein. The teachings of the PIC12F629 datasheet are incorporated herein by reference. The microcontroller 50 has internal and external oscillator options.

In the embodiment illustrated in FIGS. 3A and 3B, the microcontroller 1050 can utilize power saving sleep mode. The microcontroller 1050 provides power-up time and oscillator start-up timer. The pin 7 of microcontroller 1050 is electrically connected to switching regulator 1030 pin 10. In the particular embodiment illustrated in FIGS. 3A and 3B, the pin 6 of microcontroller 1050 is electrically coupled to a GATE of the first FET 1100. The pin 2 of microcontroller 1050 is electrically coupled to the GATE of the second FET 1110. Further, the pin 3 of microcontroller 1050 is electrically connected to the GATE of a third plurality of FET 1120. The pin 4 of microcontroller 1050 is electrically connected to MSLR of 5V power supply 1042. The microcontroller 1050 is powered through pin 1 which is electrically coupled to a 5 voltage source.

Figure 4A:
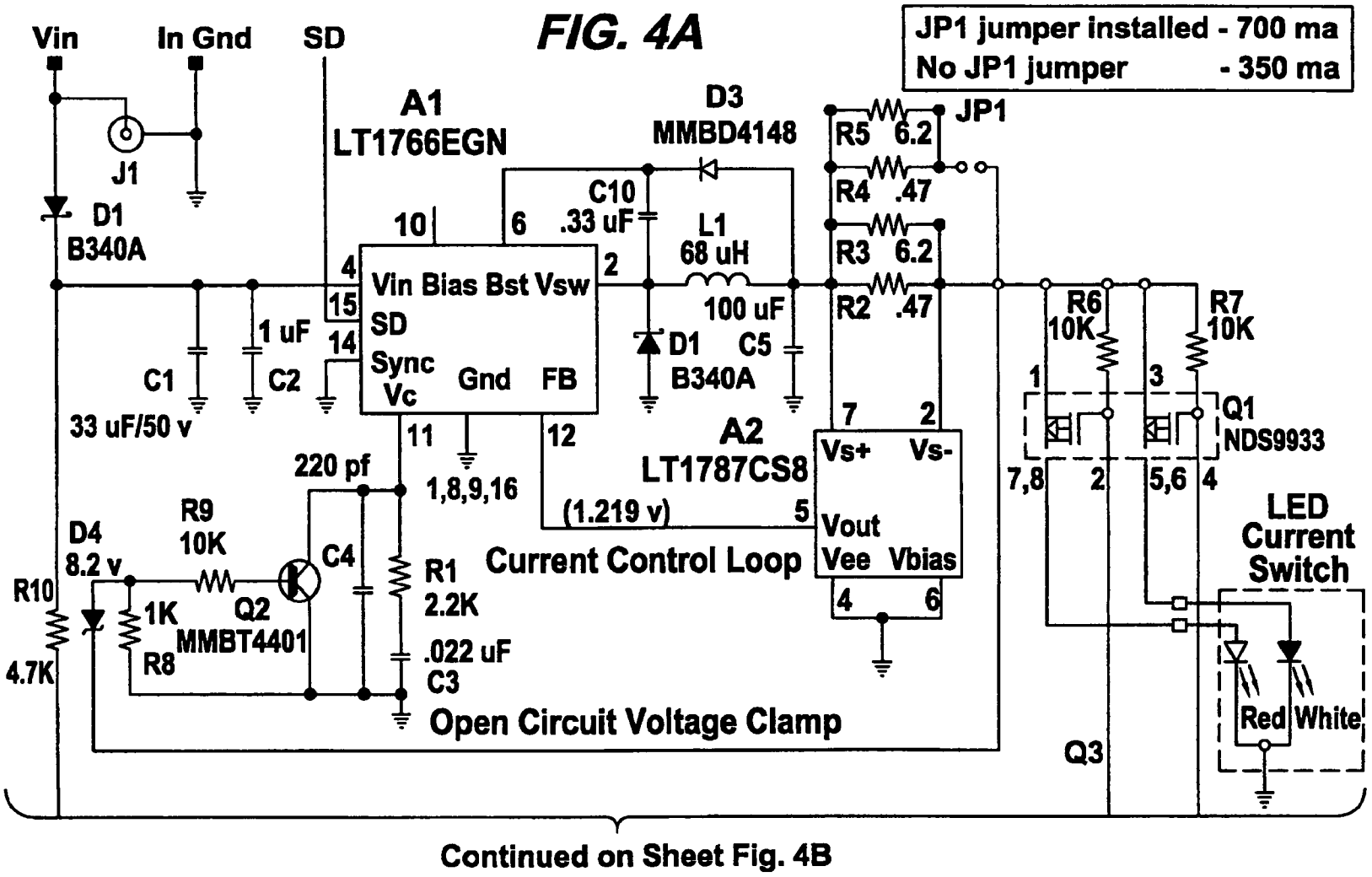
FIGS. 4A and 4B are circuit diagrams illustrating a second specific example of circuitry which can be used in connection with the dual color arrangement.
Figure 4B:
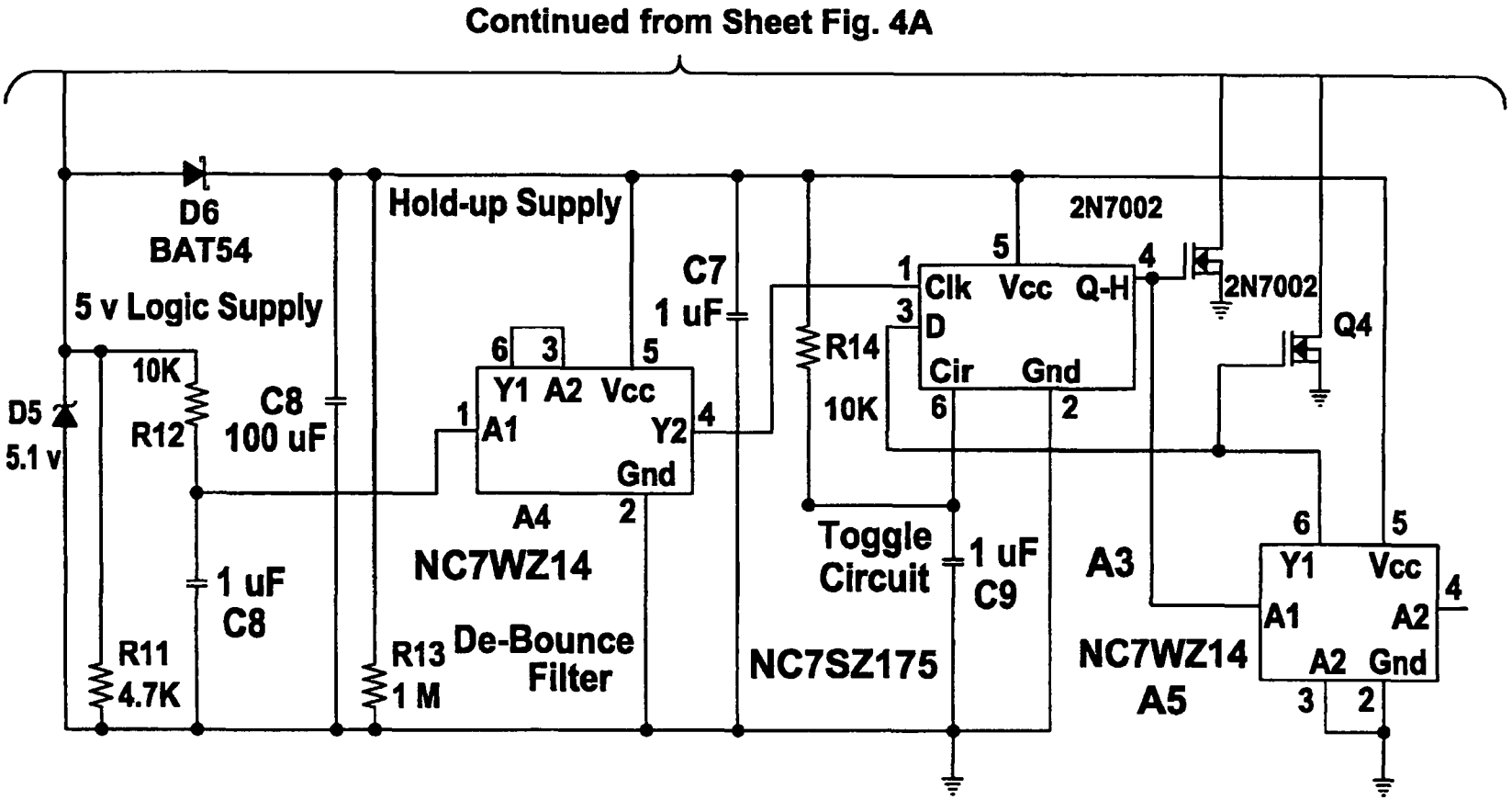

In the embodiment illustrated in FIGS. 4A and 4B, the pin 10 SHDN of switching regulator 1030 provides high low signal to microcontroller 1050 pin 7. The high low signal of switching regulator 1030 will turn switching regulator 1030 on and off. The microcontroller 1050 will receive on and off signal from switching regulator 1030 via microcontroller 1050 pin 7. The on and off signal will change color light color sequence as configured by software is OFF, LED1, LED2, LED3, OFF, LED 1 etc.

The voltage regulator circuit 1430 comprises a voltage regulator 1435, a plurality of capacitors and a plurality of diodes configured in the illustrated manner. The voltage regulator 1435 preferably part number LT3010, available from the Linear Technology Corporation, Milpitas Calif. The teachings of the LT3010 datasheet are incorporated herein by reference.

In this instance, the voltage regulator 1435 is a high voltage, micro power low dropout linear regulator. Some illustrative examples of this embodiment comprise the ability to operate with very small output capacitors. Pin 1 of voltage regulator 1435 utilizes output supplies power to the load. A minimum output capacitor is required to prevent oscillations. Larger output capacitors will be required for applications with large transient loads to limit peak voltage transients. According to another embodiment of the preferred invention directed to the pin 2 of voltage regulator 1435 is the SENSE pin.

Optimum regulation is obtained at the point where the SENSE pin is connected to the OUT pin of the regulator. The Pin 8 of voltage regulator 1435 is the input pin. Some illustrative examples of this embodiment include power is supplied to the device through the input pin. A bypass capacitor is required on this pin if the device is more than six inches away from the main input filter capacitor.

The 5V power supply 42 is electrically coupled to the pin 4 of microcontroller 1050.

FIGS. 4A and 4B depict a circuit arrangement which can be used in connection with the embodiments of the present invention. As illustrated, this circuit comprises: a 5v logic supply; an open circuit voltage clamp; a current control loop; a hold-up supply; a de-bounce filter; a toggle circuit and a LED current switch; circuited in the illustrated manner. As will be appreciated, the toggle circuit is responsive to interrupts in the Vin voltage via the Zener diodes D1 and D6. Capacitor C6 is arranged to maintain the operation of the toggle circuit for a predetermined short period to enable the toggling operation to implemented in response to the interrupt.

The supply of current to the red and white LED is controlled by the FET in the toggle circuit and the LED current switch. The FET in the LED switch are selectively rendered conductive by inputs which pass through the FET in the toggle circuit. When current is supplied to the circuit arrangement shown in FIGS. 4A and 4B the red and white LED are selectively energized in accordance with which of the FET in the LED current switch is rendered conductive. It should also be noted that the current control loop is circuited in this arrangement to provide a feedback control which ensures that a constant current is supplied to the each of the LED under all conditions.

As will be appreciated, the layout of the FIGS. 4A and 4B circuit differs in that the FET are not used to control ground as in the previous arrangements. Further, this particular arrangement is limited to only two colors—red and white. It is however, deemed within the purview of those skilled in the art when equipped with the preceding disclosure, to compile a circuit based on that which is illustrated in this figure, where more than two LED are provided and the toggling circuit appropriately changed to accommodate their selective energization.

It will be readily appreciated by one of ordinary skill in the art that after reading the foregoing specification, one of skill in this art of that which is most relevant will be able to affect various changes, modifications, substitutions of equivalents to the various other aspects of the invention as broadly disclosed herein. It is therefore intended that the protection granted hereon be limited only by the definition contained in the appended claims and equivalents thereof.

The invention claimed is:

1. A system for changing between a plurality of colors of light via toggling a single switch, the system comprising:

a power source electrically connected via a switch to a regulator;

a microcontroller electrically connected to the regulator to receive power from the power source, the microcontroller configured to respond to interruptions in voltage from the power source;

an input capacitor electrically connected via an internal power supply to the microcontroller, the input capacitor selected to maintain a supply of power from the internal power supply to the microcontroller for a predetermined time period comprising a time period greater than a time period of an interruption to the power source;

a plurality of light sources electrically connected to receive power via the regulator, each light source configured to generate a different color when energized;

wherein toggling of the switch causes the interruption of power from the power source, the microcontroller powered during the interruption and for the predetermined time period by the supply of power from the internal power supply; and wherein the microcontroller detects the interruption of power via the power source and responsive to the detection the microcontroller energizes a light source of the plurality of light sources.

2. The system of claim 1, wherein the power source comprises an external 9-30v DC power source.

3. The system of claim 1, wherein the internal power supply comprises a 5V power supply.

4. The system of claim 1, wherein the microcontroller energizes the light source during the predetermined time period of receiving power from the internal power supply.

5. The system of claim 1, wherein the input capacitor is selected to maintain the supply of power from the internal power supply for the predetermined time period comprising a time period within a range of between two and four seconds.

6. The system of claim 1, wherein the input capacitor is selected to maintain the supply of power from the internal power supply for the predetermined time period comprising the time period greater than comprising the time period of the interruption to the power source by at least a predetermined amount.

7. The system of claim 1, wherein the microcontroller is electrically connected to a plurality of field effect transistors, each field effect transistor of the plurality of field effect transistors controlling a connection between a corresponding light source of the plurality of light sources and ground.

8. The system of claim 7, wherein responsive to the detection the microcontroller energizes the light source of the plurality of light sources by sending a control signal to a field effect transistor to render the field effect transistor conductive to establish a ground connection and wherein current from the regulator is permitted to flow to the field effect transistor.

9. The system of claim 1, wherein the microcontroller detects that the interruption of power from the power supply is interrupted at least a defined duration of time.

10. The system of claim 1, wherein upon detecting power from the power supply has resumed the microcontroller shuts off the regulator and changes to a next field effect transistor as designated in a toggle control program.

11. The system of claim 1, wherein the regulator comprises one of a linear regulator or a switching regulator.

12. A light fixture configured to change between a plurality of colors of light via interruption to an external power source, the light fixture comprising:

a regulator electrically connected to an external power source;

a microcontroller electrically connected to the regulator to receive power from the external power source;

an internal power supply electrically connected to the microcontroller and a capacitor, the capacitor configured to maintain a supply of power from the internal power supply to the microcontroller for a predetermined time period comprising a time period greater than a time period of an interruption to the external power source; and a plurality of light emitting diodes (LEDs) electrically connected to the regulator, each LED configured to emanate a different color;

wherein the microcontroller detects the interruption of power from the external power source and responsive to the detection sends a signal to trigger a light source of the plurality of light sources to emanate, the microcontroller maintaining power during the interruption by the supply of power from the internal power supply for the predetermined time period.

13. The light fixture of claim 12, wherein the external power source is controlled by a switch.

14. The light fixture of claim 13, wherein toggling the switch causes the interruption of power from the external power source.

15. The light fixture of claim 12, further comprising a plurality of field effect transistors electrically connected to the microcontroller, each field effect transistor of the plurality of field effect transistors controlling a connection between a corresponding light source of the plurality of light sources and ground.

16. The light fixture of claim 15, wherein responsive to the detection the microcontroller sends the signal to a field effect transistor corresponding to a LED of the plurality of LEDs.

17. The light fixture of claim 16, wherein responsive to the signal the field effect transistor is conductive to establish a ground connection and responsive to the establishing the ground connection current from the regulator is permitted to flow to the field effect transistor.

18. The light fixture of claim 16, wherein the regulator comprises one of a linear regulator or a switching regulator.

19. The light fixture of claim 12, wherein the microcontroller detects that the interruption of power from the power supply exceeds a predetermined duration of time.

20. The light fixture of claim 12, wherein upon detecting power from the power supply has resumed the microcontroller shuts off the regulator and changes to a next field effect transistor as designated in a toggle control program.

21. The light fixture of claim 12, wherein the predetermined time period comprises the time period greater, by at least a predetermined amount, than the time period of interruption to the external power source from toggling a switch.

22. The light fixture of claim 12, wherein the microcontroller sends the signal for a LED of the plurality of LEDS designated by a toggling control program.

* * * * *